US005662968A

United States Patent [19]

Yamaguchi

[11] Patent Number: 5,662,968

[45] Date of Patent: Sep. 2, 1997

[54] METHOD OF PAINTING BUILDING BOARD BY SPRAY PAINTING APPARATUS

[75] Inventor: Takahiro Yamaguchi, Ichinomiya, Japan

[73] Assignee: Nichiha Corporation, Nagoya, Japan

[21] Appl. No.: 681,502

[22] Filed: Jul. 23, 1996

[30] Foreign Application Priority Data

Jul. 24, 1995 [JP] Japan ..... 7-186780

[51] Int. Cl.[6] ..... B05D 7/00

[52] U.S. Cl. ..... 427/421; 427/424; 118/313; 118/314; 118/315; 118/316; 118/323; 118/324; 118/DIG. 9

[58] Field of Search ..... 427/421, 424; 118/313, 314, 315, 316, 323, 324, DIG. 9

[56] References Cited

U.S. PATENT DOCUMENTS

| | | | |
|---|---|---|---|
| 3,811,409 | 5/1974 | Porter | 118/323 |
| 4,220,115 | 9/1980 | Brossman et al. | 118/684 |
| 5,571,562 | 11/1996 | Wakat | 427/280 |

FOREIGN PATENT DOCUMENTS 6-64750 9/1994 Japan .

*Primary Examiner*—Shrive Beck
*Assistant Examiner*—David M. Maiorana
*Attorney, Agent, or Firm*—Foley & Lardner

[57] ABSTRACT

In a method of painting a building board being conveyed on a conveyor by means of a spray painting apparatus so that a plurality of colors of gradated or shaded patterns are formed, a plurality of spray guns are connected to a plurality of paint supply systems supplying different colors of paint, respectively. The spray guns are arranged in parallel to a direction in which the building board is conveyed. With the spray guns being reciprocated in a direction crossing the direction in which the building board is conveyed, each of the spray guns is intermittently turned on and off so that the paints of colors different from one another are sprayed from the spray guns onto the surface of the building board. The relation between a speed of the reciprocation of each spray gun and a speed of conveyance of the building board is expressed by $L \leqq P \times N$ where L is a distance that the building board is conveyed during one reciprocation of the spray guns, P is an average arrangement pitch of the spray guns, and N is the number of the spray guns.

4 Claims, 3 Drawing Sheets

METHOD OF PAINTING BUILDING BOARD BY SPRAY PAINTING APPARATUS

BACKGROUND OF THE INVENTION

1. Field of the Invention

This invention relates to a method of painting a surface of a building board being conveyed on a conveyor by means of a spray painting apparatus so that a plurality of colors of gradated or shaded patterns are formed thereon.

2. Description of the Prior Art

Publication No. 6-64750 (1994) of an unexamined Japanese utility model registration application discloses a conventional method of painting a surface of a building board being conveyed on a conveyor by a spray painting apparatus so that a plurality of colors of patterns are formed thereon. In the disclosed method, a plurality of paint supply systems are provided for supplying a plurality of different colors of paints. The paint supply systems are switched in accordance with a predetermined timing so that the different colors of paints are supplied to a single spray gun. The paints thus supplied from the respective paint supply systems are sprayed from the spray gun in accordance with respective timings different from one another. Patterns of a plurality of colors are painted on the surface of a building board which is conveyed below the spray gun on a conveyor.

In the above-described painting method, however, the paints of different colors are mixed together in the spray gun after the paints are switched from one color to another, since the different colors of paints are supplied from the respective paint supply systems to the single spray gun. This disadvantageously renders the colors of the paints different from their original ones. Furthermore, the use of a single spray gun cannot provide an efficient painting work when an article to be painted has a relatively large width, e.g. a building board. This reduces the productivity.

SUMMARY OF THE INVENTION

Therefore, an object of the present invention is to provide a method of painting a building board by a spray painting apparatus, wherein a plurality of colors of natural gradated or shaded patterns can be painted on the building board.

To achieve the object, the present invention provides a method, a plurality of spray guns are connected to a plurality of paint supply systems supplying different colors of paints respectively. The spray guns are arranged in parallel to a direction in which a building board is conveyed on a conveyor. Each of the spray guns is intermittently turned on and off in accordance with a predetermined timing while the spray guns are being reciprocated in a direction crossing the direction in which the building board is conveyed, whereby the paints of colors different from one another are sprayed from the respective spray guns onto the surface of the building board so that a plurality of colors of natural gradated or shaded patterns are painted on the building board.

The relation between a speed of reciprocation of each spray gun and a speed of conveyance of the building board is expressed by $L \leqq P \times N$ where L is a distance that the building board is conveyed during one reciprocation of the spray guns, P is an average arrangement pitch of the spray guns, and N is the number of the spray guns. The speed of conveyance of the building board is so high that an unsprayed portion or portions are left on the surface of the building board, where $L > P \times N$. However, where $L \leqq P \times N$, any one of colors of paints can be sprayed onto every portion of the surface of the building board, and a position of paint spraying by each spray gun or a spraying timing can be designated in fine pitches in the direction of conveyance of the building board. Consequently, variations in the gradated patterns can be increased.

The speed of reciprocation of each spray gun is preferably set in a range between 55 and 140 m/min. The painting can efficiently be carried out without reductions in the painting quality when the reciprocation speed of each spray gun is in the above-mentioned range.

Furthermore, the arrangement pitch of each spray gun is preferably set so that a spray range of each spray gun is partially overlapped with a spray range of the other spray gun on the surface of the building board. Since each gradated pattern is overlapped on a part of the other pattern, the variations in the gradated patterns can further be increased.

Furthermore, each spray gun preferably has a stroke of reciprocation larger than a width of the building board. Both end portions of the building board can uniformly be painted as well as its central portion.

BRIEF DESCRIPTION OF THE DRAWINGS

Other objects, features and advantages of the present invention will become clear upon reviewing the following description of preferred embodiments thereof, made with reference to the accompanying drawings, in which.

DETAILED DESCRIPTION OF THE PREFERRED EMBODIMENT

Figure 2:
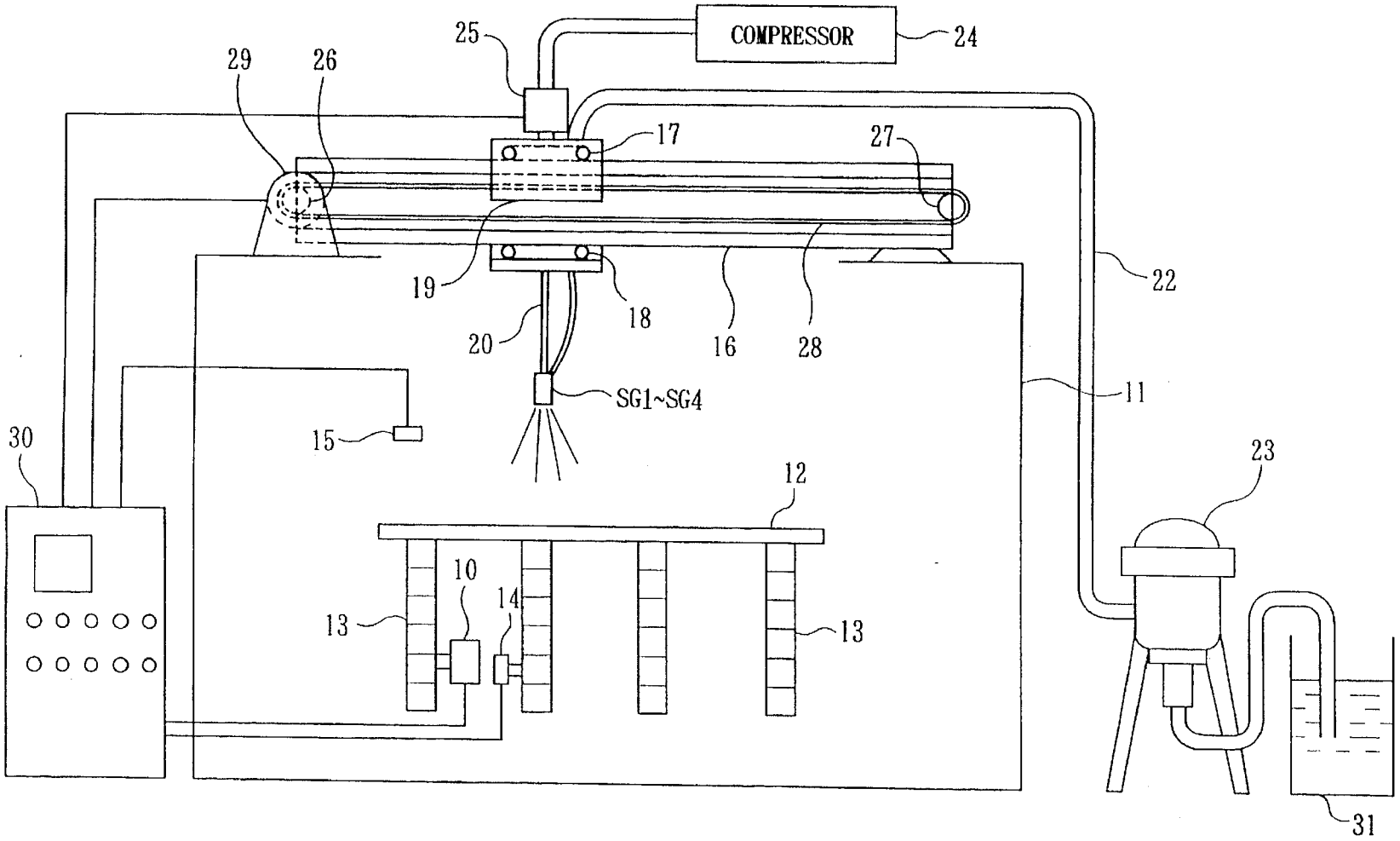
FIG. 2 is a schematic front view of a reciprocating spray painting apparatus.

One embodiment of the present invention will be described with reference to the accompanying drawings. Referring first to FIG. 2, a reciprocating spray painting apparatus is schematically shown. The apparatus includes a painting booth 11 in which a chain conveyor 13 is provided for conveying a building board 12. The chain conveyor 13 is driven by an electric motor 10. Revolution (a speed of conveyance) of the motor 10 is detected by a rotary encoder 14. A photoelectric sensor 15 is provided at an entrance of the spraying booth 11 for detecting the building board 12 passing therethrough, thereby generating a detection signal. Spray guns SG1 to SG4 are controlled to be turned on and off on the basis of the detection signal generated by the photoelectric sensor 15 in a manner as will be described later. A pair of rails 16 are provided along a roof of the booth 11 so as to horizontally extend in a direction crossing a direction in which the building board 12 is conveyed. A slide plate 19 is slidably mounted on rollers 17 and 18 which are further mounted on the rails 16.

Figure 3:
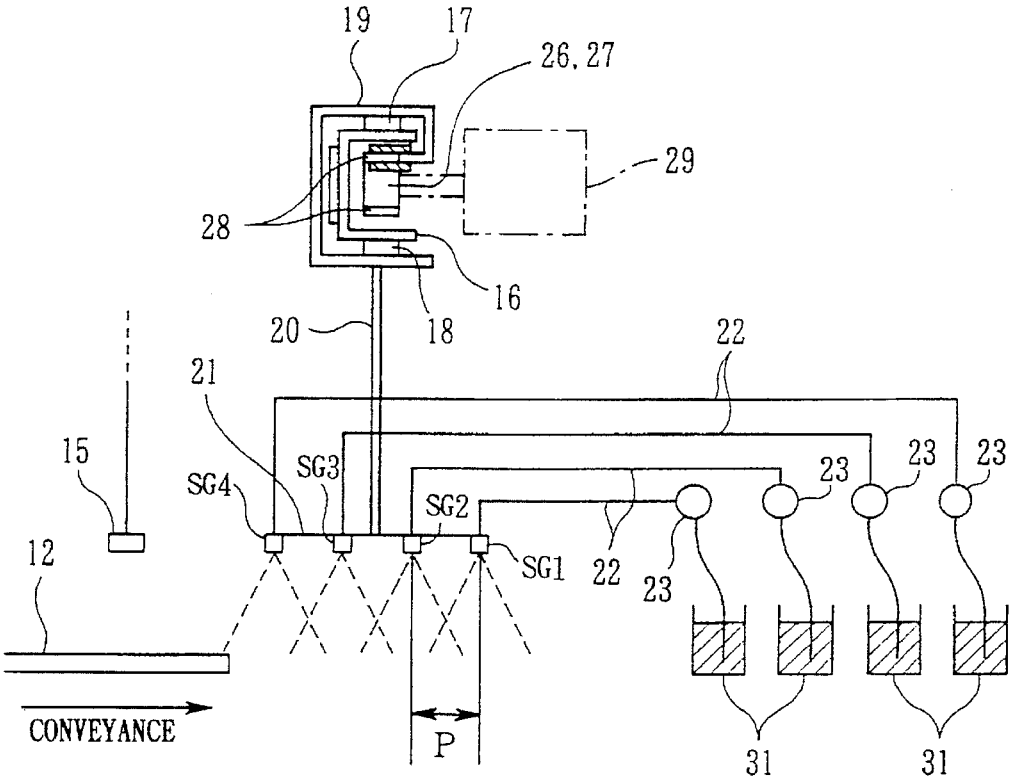
FIG. 3 is a side view of a major portion of the reciprocating spray painting apparatus.
Figure 4:
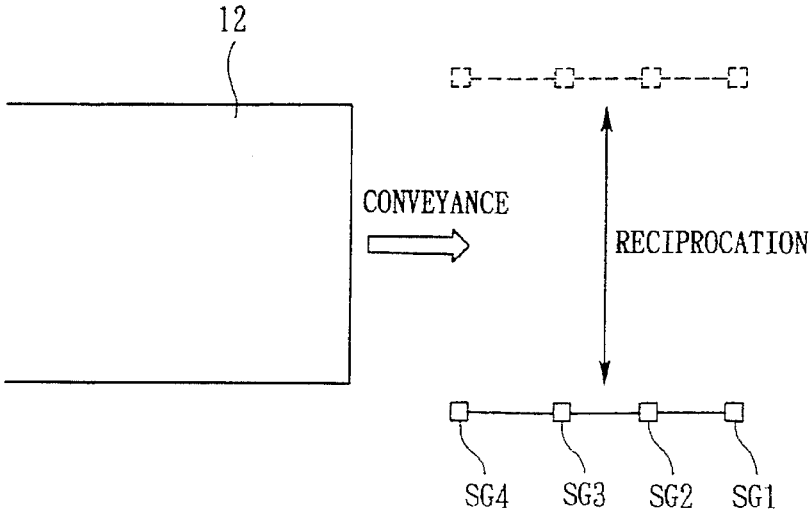
FIG. 4 illustrates the relation between a direction in which the building board is conveyed and a direction of reciprocating movement of the spray guns SG1–SG4.

The slide plate 19 has a suspended support bar 20 fixed thereto. A connecting arm 21 is fixed to a lower end of the support bar 20, as is shown in FIG. 3. Four spray guns SG1 to SG4, for example, are mounted on the connecting arm 21 so as to be arranged in equal pitches in parallel to the direction in which the building board 12 is conveyed. An arrangement pitch P of each of the spray guns SG1–SG4 is set at approximately 20 cm so that a spray range of each spray gun is partially overlapped with a spray range of the other spray gun on the surface of the building board 16 such that a uniform painting can be provided over the entire surface of the building board 12. In this case, a distance between the building board 12 and each of the spray guns SG1–SG4 is set at 30 cm. The spray guns SG1–SG4 are connected to respective paint hoses 22 constituting respective paint supply systems. A plurality of pumps 23 (four in the embodiment) are connected to the paint hoses 22 and a plurality of paint tanks 31 (four in the embodiment) reserving different colors of paints so that the different colors of paints are force supplied from the paint tanks 31 through the paint hoses 22, respectively. A high pressure air is supplied from a compressor 24 via an electromagnetic valve 25 to each of the spray guns SG1–SG4.

The slide plate 19 supporting the support arm 20 further supporting the spray guns SG1–SG4 is coupled to a rubber belt 28 extending between drive and driven sprockets 26 and 27 mounted on both ends of the rails 16 respectively. The rubber belt 28 is rotated so that the slide plate 19 is reciprocated along the rails 16, thereby reciprocating the spray guns SG1–SG4 in the direction crossing the direction in which the building board 12 is conveyed. An AC servomotor 29 serves as a drive source for the drive sprocket 26. Another rotary encoder (not shown) is provided for detecting revolution of the servomotor 29, thereby generating a pulse signal. The AC servomotor 29 is adapted to reverse its direction of revolution or the direction of rotation of the rubber belt 28 at a point of reverse in the reciprocating movement of the spray guns SG1–SG4 on the basis of the pulse signal generated by the rotary encoder. In this regard, a stroke of reciprocation of each spray gun is set to be larger than a width of the building board 12.

The reciprocating spray painting apparatus constructed as described above is controlled by a control device 30 in the following manner. First, the relation between a speed of the reciprocation of each of the spray guns SG1–SG4 and a speed of conveyance of the building board 12 is set to be expressed by $L \leqq P \times N$ where L is a distance that the building board is conveyed during one reciprocation of the spray guns, P is an average arrangement pitch of the spray guns, and N is the number of the spray guns. Preferably, the speed of reciprocation of each of the spray guns SG1–SG4 is set in a range between 55 and 140 m/min. The speed of conveyance of the building board 12 is set on the basis of the set speed of reciprocation of each spray gun so that the above-mentioned relation is expressed by $L \leqq P \times N$. The reason for the above-described setting is that where $L > P \times N$, the speed of conveyance of the building board 12 is so high that one or more unsprayed portions are left on the surface of the building board 12. Where $L \leqq P \times N$, however, any of colors of paint can be sprayed over the surface of the building board 12, and a position of paint spraying by each of the spray guns SG1–SG4 or a spraying timing can be designated in fine pitches in the direction of conveyance of the building board 12. Consequently, variations in gradated or shaded patterns provided by the paints can be increased.

Figure 1A:
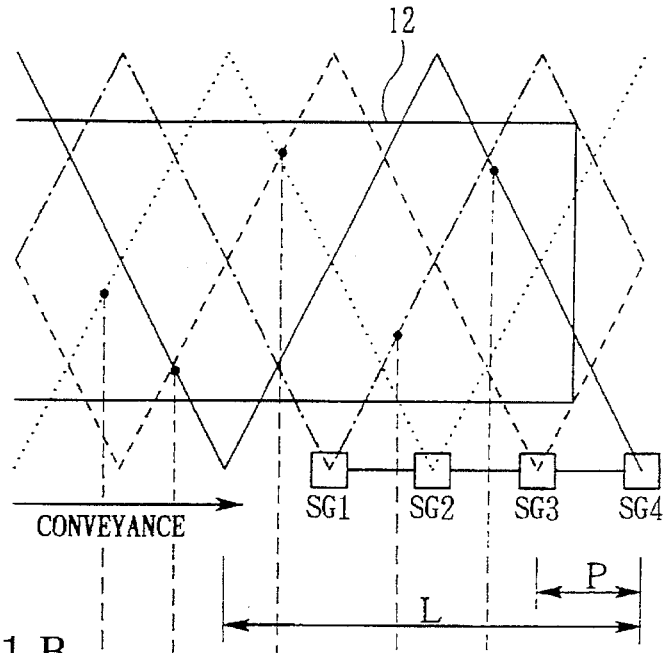
FIG. 1A illustrates movement loci of spray guns SG1 to SG4 employed in one embodiment in accordance with the present invention.
Figure 1B:
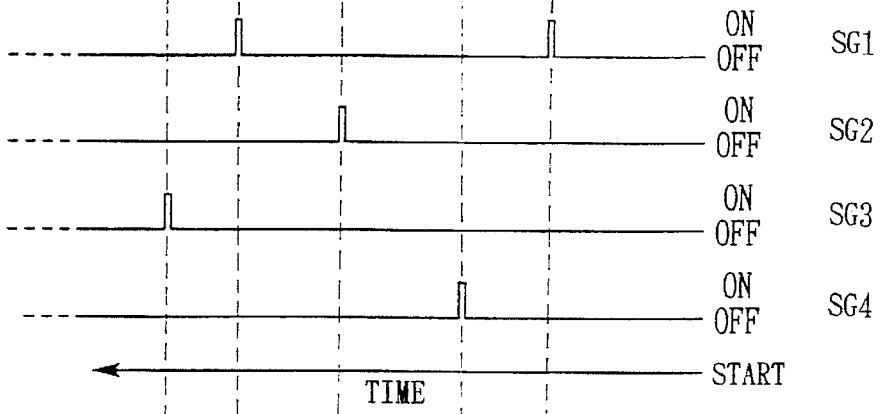
FIG. 1B illustrates timings of the spray guns SG1–SG4.
Figure 1C:
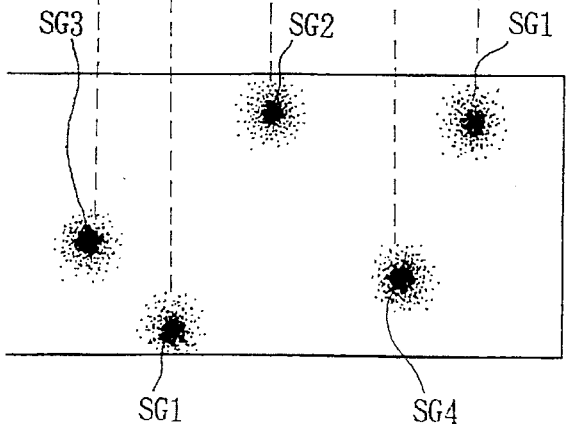
FIG. 1C schematically illustrates patterns painted on a building board by the spray guns operated in accordance with the timings shown in FIG. 1B.

Each of the spray guns SG1–SG4 is intermittently turned on and off in accordance with a predetermined timing as shown in FIG. 1B while the spray guns SG1–SG4 are being reciprocated in the direction crossing the direction in which the building board 12 is conveyed. Consequently, the paints of colors different from one another are sprayed from the spray guns SG1–SG4 onto the surface of the building board 12 so that a plurality of colors of natural gradated patterns as shown in FIG. 1C are painted on the building board 12. FIGS. 1B and 1C show the case where a smaller number of gradated patterns is painted on the surface of the building board 12 for the purpose of simplification of illustration. However, the number of on/off switching operations may be set at a desired value so that the density of the gradated patterns can be adjusted. Furthermore, the different colors of paints sprayed from the respective spray guns SG1–SG4 are not overlapped in the case shown in FIGS. 1B and 1C. However, spraying timings of the spray guns SG1–SG4 may be set so that each of the different colors of paints is partially overlapped with the other or others on the surface of the building board 12.

The spray guns SG1–SG4 may have different diameters of spray nozzles from one another so that different types of gradated patterns are painted per color. Although the spray guns SG1–SG4 have the arrangement pitches P equal to one another in the foregoing embodiment, the pitches P may be varied per color. In this case, too, an average arrangement pitch P, that is, an average value of the arrangement pitches is used in the determination of the above-described relation between the speed of reciprocation of each of the spray guns SG1–SG4 and the speed of conveyance of the building board 12.

The number of the spray guns may be three or less, or five or more. The spray guns may be arranged in two or more rows when a large number of spray guns are used.

The foregoing description and drawings are merely illustrative of the principles of the present invention and are not to be construed in a limiting sense. Various changes and modifications will become apparent to those of ordinary skill in the art. All such changes and modifications are seen to fall within the true spirit and scope of the invention as defined by the appended claims.

What is claimed is:

1. A method of painting a surface of a building board being conveyed on a conveyor by means of a spray painting apparatus so that a plurality of colors of gradated or shaded patterns are formed thereon, the method comprising the steps of:

arranging a plurality of spray guns supplied with paints of colors different from one another in parallel to a direction in which the building board is conveyed; and while the spray guns are being reciprocated in a direction crossing the direction in which the building board is conveyed, intermittently turning on and off each of the spray guns so that the paints of colors different from one another are sprayed from the respective spray guns onto the surface of the building board;

wherein the relation between a speed of the reciprocation of each spray gun and a speed of conveyance of the building board is expressed by $L \leqq P \times N$ where L is a distance that the building board is conveyed during one reciprocation of the spray guns, P is an average arrangement pitch of the spray guns, and N is the number of the spray guns.

2. The method of claim 1 wherein the speed of the reciprocation of each spray gun is set in a range between 55 and 140 m/min.

3. The method of claim 1 wherein the arrangement pitch of each spray gun is set so that a spray range of each spray gun is partially overlapped with a spray range of an adjacent spray gun on the surface of the building board.

4. The method of claim 1 wherein each spray gun has a stroke of reciprocation larger than a width of the building board.

* * * * *